US005418049A

United States Patent [19]

Drougge

[11] Patent Number: 5,418,049

[45] **Date of Patent: * May 23, 1995**

[54] CEMENTED CARBIDE ROLL FOR ROLLING METAL STRIPS AND WIRE FLATTENING

[75] Inventor: Lars G. Drougge, Djurhamn, Sweden

[73] Assignee: Sandvik AB, Sandviken, Sweden

[ * ] Notice: The portion of the term of this patent subsequent to Apr. 4, 2012 has been disclaimed.

[21] Appl. No.: 13,369

[22] Filed: Feb. 4, 1993

[30] Foreign Application Priority Data

Feb. 7, 1992 [SE] Sweden ..... 9200365

[51] Int. Cl.[6] ..... B32B 15/04

[52] U.S. Cl. ..... 428/215; 407/119; 51/307; 51/309; 428/332; 428/469; 428/698

[58] Field of Search ..... 428/698, 332, 469, 215; 407/119; 51/307, 309

[56] References Cited

U.S. PATENT DOCUMENTS

| | | | |
|---|---|---|---|
| 4,705,124 | 11/1987 | Abrahamson et al. | 175/410 |
| 4,743,515 | 5/1988 | Fischer et al. | 428/698 |
| 4,820,482 | 4/1989 | Fischer et al. | 419/15 |
| 5,235,879 | 8/1993 | Drougge | 83/13 |

FOREIGN PATENT DOCUMENTS

| | | |
|---|---|---|
| 504803 | 5/1939 | United Kingdom . |
| 2036620 | 7/1980 | United Kingdom . |

*Primary Examiner*—A. A. Turner
*Attorney, Agent, or Firm*—Burns, Doane, Swecker & Mathis

[57] ABSTRACT

There is provided a cemented carbide roll for rolling metal strips and wire flattening containing WC and with a binder that comprises at least one of the metals Co, Ni or Fe. Moreover, it consists of a core of eta-phase containing cemented carbide surrounded by an eta-phase free surface zone on the rolling surface of the roll and with the sides of the roll comprising exposed eta-phase.

11 Claims, 1 Drawing Sheet

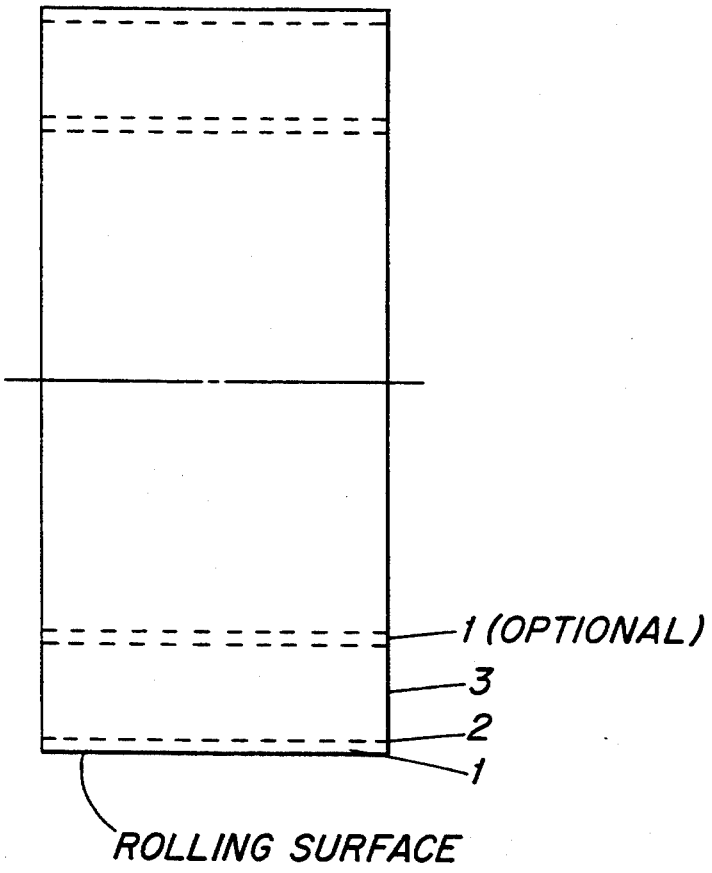
1 (OPTIONAL)
3
2
1
ROLLING SURFACE

CEMENTED CARBIDE ROLL FOR ROLLING METAL STRIPS AND WIRE FLATTENING

BACKGROUND OF THE INVENTION

The present invention relates to a cemented carbide roll for rolling metal strips and flattening of wire which by means of a special way of manufacturing has surprising properties in comparison to those of a conventional roll.

A conventional cemented carbide roll has a wear pattern where pitting occurs caused by particles sticking to the strip or to the wire. These pits or indentations in the roll lower the quality of the product thereafter rolled to an unacceptable level which is why the roll mill must be stopped for reconditioning or exchange of the rolls. A reconditioning typical for a conventional cemented carbide roll includes a grinding operation that reduces the diameter of the roll by 0.5 mm as an average.

In U.S. Pat. No. 4,743,515, incorporated herein by reference, there is disclosed a cemented carbide preferably for use in rock drilling but also for wear parts and other parts exposed to wear. It is characterized by a core containing eta-phase surrounded by cemented carbide free from eta-phase.

OBJECTS AND SUMMARY OF THE INVENTION

It is an object of the present invention to avoid or alleviate the problems of the prior art.

It is another object of the present invention to provide a roll for rolling metal strips and wire flattening which has improved properties as well as efficacious methods of making and using such roll.

In one aspect of the invention there is provided a generally cylindrical cemented carbide roll for rolling metal strips and wire flattening having a rolling surface and containing WC, a binder based on at least one of the metals Co, Ni and Fe and eta-phase, said rolling surface having a surface zone of eta-phase free cemented carbide and the surfaces of the flat sides of the roll having exposed eta-phase.

In another aspect of the invention there is provided a method of manufacturing a cemented carbide roll for rolling strips and wire flattening by powder metallurgical methods comprising sintering a generally cylindrical sub-stoichiometric cemented carbide body to form an eta-phase containing cemented carbide blank which thereafter is at least partly carburized on the cylindrical portion, the flat sides of the roll being protected from carburization to form an eta-phase containing core having an eta-phase free surface zone on the cylindrical portion and eta-phase exposed on the flat sides of the roll.

In still another aspect of the invention there is provided in the use of a generally cylindrical cemented carbide roll for rolling strip and for wire flattening containing WC (alpha-phase) with a binder (beta-phase) based on at least one of the metals Co, Ni or Fe the improvement comprising the use of a roll comprising cemented carbide containing an eta-phase cemented carbide with an eta-phase free surface zone on the cylindrical portion of said roll with the eta-phase exposed on the flat sides of the roll.

BRIEF DESCRIPTION OF THE FIGURE

The FIGURE shows a cross-section view of a roll in accordance with the invention where:

1 Cemented carbide, depleted of Co, no eta-phase;
2 Cobalt-enriched area; and
3 Cemented carbide with eta-phase.

DETAILED DESCRIPTION OF THE PREFERRED EMBODIMENTS OF THE INVENTION

According to the invention, a cemented carbide roll is provided for rolling of strips and wire flattening. The roll is generally cylindrical in shape although it is understood that other, equivalent shapes may be used. The roll may be solid or a roll ring. The roll is made of cemented carbide mainly consisting of WC+a binder based on Co, Ni or Fe. The amount of binder should be 5–20%, preferably 6–16%, by weight. The grain size of the WC used should be less than 5 μm preferably 0.4–3 μm. The cemented carbide may contain less than 3%, preferably less than 1%, of other carbides such as TiC, TaC, NbC, VC, $Mo_2C$ and HfC.

The core of the cemented carbide in accordance with the invention comprises an eta-phase containing cemented carbide surrounded at least on the rolling surface and, if desired, also on the inner surface by cemented carbide free from eta-phase with the exception for the flat (non-rolling) sides of the roll where the eta-phase is exposed. The eta-phase has a fine grain size of 0.5–10 μm, preferably 1–5 μm. The eta-phase grains should be evenly distributed within the matrix of the normal structure of WC and binder in the core. In the transition area towards the eta-phase free cemented carbide, the eta-phase may have a slightly coarser grain size than otherwise in the core. The content of eta-phase in the core is 2–60%, preferably 10–35%, by volume.

The thickness of the eta-phase free cemented carbide shall be 0.2–10 mm, preferably 0.5–8 mm. In the inner part of the eta-phase free structure zone, situated close to the core, the amount of binder is greater than the nominal amount of binder in the cemented carbide body. In the outermost part of the eta-phase free zone, the binder is depleted, the amount of binder being 0.1–0.9, preferably 0.2–0.7, times the nominal content of binder. The thickness of the outermost binder depleted zone is 0.2–0.8, preferably 0.3–0.7, times the width of the eta-phase free zone.

The inner part of the eta-phase depleted zone next to the eta-phase containing core shall have a content of binder that is greater than the nominal and shall increase towards the core up to a maximum of at least 1.2 times, preferably 1.4–2.5 times, the nominal content of binder in the cemented carbide body.

The cemented carbide roll in accordance with the invention is manufactured by powder metallurgical methods such as milling, pressing and sintering. The powder used is sub-stoichiometric with regard to the carbon content and is sintered to an eta-phase containing cemented carbide blank that afterwards is partly carburized in a way that an eta-phase free surface zone is created. The side surfaces of the roll which comprise exposed eta-phase are obtained by protecting those surfaces from carburization with adjoining material or with a coating of material protecting against reactions during the carburizing heat treatment, e.g., a carburization resistant material.

Although we do not wish to be bound, an explanation for the good properties of the roll of the present invention may be the reduction of the axial prestresses which are introduced by the carburizing treatment. This would cause the special wear pattern, namely the very shallow flaking of the cylindrical surface that takes place when a particle passes the roll during the rolling operation.

The reconditioning time of the roll in accordance with the invention is very short even when a particle has passed the roll as the pitting in this case is much more shallow than that of a normal roll and less material need to be removed. When flat rolling with the roll of the present invention, the exceedingly small diameter reduction is of great value as the size of the roll diameter is an important factor for the broadening of the wire and also to the tolerances of the width of the roll.

The invention has been described with reference to a ring-shaped roll. It is obvious that the invention can be applied also to rolls of other shapes such as cylindrical.

The invention is additionally illustrated in connection with the following Examples which are to be considered as illustrative of the present invention. It should be understood, however, that the invention is not limited to the specific details of the Examples.

EXAMPLE 1

From a powder containing 2–3 μm WC and 11% Co with a sub-stoichiometric carbon content (5.1% instead of 5.4%), ring shaped blanks were pressed to a height of 56.2 mm, shaped to an outside diameter of 122.8 mm and an inside diameter of 82.3 mm. The blanks were presintered in nitrogen for 1 hour at 900° C. and standard sintered at 1410° C. Then the blanks were packed with the flat sides against $ZrO_2$-sprayed graphite rings on normal graphite trays. The blanks were then heat treated for 10 hours at a temperature of 1370° C. A zone of only $\alpha+\beta$ structure was formed in the cylindrical surfaces of the blanks due to the carbon diffusion into the material followed by a transformation of the eta-phase. After 10 hours treatment enough carbon had diffused into and transformed all eta-phase of the exposed surfaces. The blanks manufactured in this way had after the treatment a 3.2 mm eta-phase free surface zone and a core containing fine-dispersed eta-phase. The part of the surface zone closest to the eta-phase containing core was enriched with cobalt and had a width of 0.8 mm. Thus, the outermost part of the surface zone, with a width of 2.4 mm, was depleted of cobalt and was consequently also harder.

EXAMPLE 2

Two sets, each consisting of six cemented carbide rolls with identical measurements, were manufactured. One set was produced according to the method described in Example 1, the second set was made in the standard grade, normally used. The two sets of rolls were alternately installed in a 3-pair continuous rolling mill of duo type working in the range 0.254×0.076 to 3.00×0.300 mm. (Width by thickness). Diameter of the rolls was 100 mm and the face length 45 mm. The rolls were kept together during the test. When one set of rolls was in operation the other was being reconditioned or in other ways attended to. The steel used for the test was mainly AISI 302.

As an average, the sets of rolls were exchanged every 440 hours of work. In total, 18 exchanges took place. The most frequent reason for exchange was metal cladding. The period of follow up was 16 months. The roll in accordance with the invention had a reduction of 0.10 mm of the diameter. The standard roll had an average reduction of 4.5 mm. The difference in diameter reduction depends on the necessary reconditioning. The roll according to the invention only needed to be wiped off with a 600 grain diamond wheel to remove the metal cladding while the standard roll had to be ground in order to remove indents of wear and marks.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A generally cylindrical cemented carbide roll for rolling metal strips and wire flattening having a rolling surface and containing WC, a binder based on at least one of the metals Co, Ni and Fe and eta-phase, said rolling surface having a surface zone of eta-phase free cemented carbide and the surfaces of the flat sides of the roll having exposed eta-phase.

2. The cemented carbide roll of claim 1 wherein the eta-phase free zone is 0.2–10 mm.

3. The cemented carbide roll of claim 2 wherein the eta-phase free zone is 0.5–8 mm.

4. The cemented carbide roll of claim 1 wherein the grain size of the eta-phase is 0.5–10 μm and the amount of eta-phase in the core is 2–60% volume %.

5. The cemented carbide roll of claim 4 wherein the grain size of the eta phase is 1–5 μm and the amount of eta phase in the core is 10–35 volume %.

6. The cemented carbide roll of claim 1 wherein the amount of binder in the outermost binder depleted zone is 0.1–0.9 times the nominal content of binder.

7. The cemented carbide roll of claim 6 wherein the amount of binder in the outermost binder depleted zone is 0.2–0.7 times the nominal content of binder.

8. The cemented carbide roll of claim 1 wherein the thickness of the outermost binder depleted zone is 0.2–0.8 times the width of the eta-phase free zone.

9. The cemented carbide roll of claim 8 wherein the thickness of the outermost binder depleted zone is 0.3–0.7 times the width of the eta-phase free zone.

10. The cemented carbide roll of claim 1 wherein the inner part of the eta-phase depleted zone next to the eta-phase containing core has a content of binder that is greater than the nominal and increases towards the core up to a maximum of at least 1.2 times the nominal content of binder in the cemented carbide body.

11. The cemented carbide roll of claim 10 wherein the binder content increases towards the core to 1.4–2.5 times the nominal content of binder in the cemented carbide body.

* * * * *